US005913771A

United States Patent [19]

Nail

[11] Patent Number: 5,913,771

[45] Date of Patent: Jun. 22, 1999

[54] END BOARD FOR SUPPORTING A CHILD'S BED HAVING MOVEABLE PIECES SLIDABLY MOUNTED THEREON

[76] Inventor: David Nail, 2 Adams Rd., Bloomfield, Conn. 06002

[21] Appl. No.: 08/920,755

[22] Filed: Aug. 29, 1997

Related U.S. Application Data

[63] Continuation-in-part of application No. 08/693,448, Aug. 7, 1996, abandoned.

[51] Int. Cl.[6] ..... A47C 17/00

[52] U.S. Cl. ..... 5/53.1; 5/280; 5/907; 446/227; 434/175

[58] Field of Search ..... 5/53.1, 907, 280, 5/281, 658; 40/415; 446/489, 479, 482, 227; 434/175

[56] References Cited

U.S. PATENT DOCUMENTS

| | | | |
|---|---|---|---|
| D. 176,586 | 1/1956 | Bogenberger . | |
| 336,266 | 2/1886 | Smith . | |
| 674,486 | 5/1901 | Talbot . | |
| 690,664 | 1/1902 | Proctor . | |
| 1,136,663 | 4/1915 | Fox . | |
| 1,184,326 | 5/1916 | Cress . | |
| 1,218,993 | 3/1917 | Fox | 434/175 |
| 1,455,522 | 5/1923 | Cress . | |
| 1,541,795 | 6/1925 | Cress . | |
| 2,471,762 | 5/1949 | Merret | 446/227 |
| 2,706,138 | 4/1955 | Luce et al. . | |
| 3,580,189 | 5/1971 | Eisenberg . | |
| 4,841,911 | 6/1989 | Houghton | 446/227 |
| 4,854,913 | 8/1989 | Kelley | 446/227 |
| 4,935,976 | 6/1990 | Milman | 5/280 |

*Primary Examiner*—Flemming Saether
*Attorney, Agent, or Firm*—McCormick, Paulding & Huber

[57] ABSTRACT

An end board for supporting a child's bed comprises a base section and an upper section extending from and spanning the width of the base section. Connected slots are defined by the upper surface of the end board. At least one child's toy is located in, and retained by the slots such that the child's toy can slide within and be positioned at any point along the connected slots. At least one of the slots extends to the peripheral edge of the upper surface and is adapted to allow one or more the child's toys to be loaded into the slots.

18 Claims, 4 Drawing Sheets

END BOARD FOR SUPPORTING A CHILD'S BED HAVING MOVEABLE PIECES SLIDABLY MOUNTED THEREON

This application is a continuation-in-part of application Ser. No. 08/693,448 filed Aug. 7, 1996 which is now abandoned.

FIELD OF THE INVENTION

The present invention relates generally to furniture for use in a child's room, and deals more particularly with an end board adapted to support a child's bed.

BACKGROUND OF THE INVENTION

The present invention has particular utility with respect to an end board for supporting a child's bed having movable children's toys mounted thereon and is described herein as applied to such use.

As used herein, the term "child's toys" should be broadly construed to mean children's blocks, educational tools such as, letters or numbers, as well as other kinds of toys, such as, for example, toy cars, planes and trains. In addition, the term end board is to be construed as meaning either a headboard or a footboard for supporting a bed.

Children tend to spend a significant portion of time playing in their bedrooms. As such, parents or other care providers typically strive to create a mentally stimulating environment for their children by supplying the child's room with a number of educational as well as fanciful toys. However, space is often limited, and therefore parents are forced to restrict the number of toys that their children can keep in their rooms at any given time. One means to alleviate this problem as well as to efficiently use the limited space in the child's room is to incorporate certain toys and or learning tools into the room's furniture.

A further difficulty which is closely related to the problems associated with limited space arises when the child plays with toys, such as, for example, blocks, which involve several discreet individual pieces. Typically, a child will arrange these types of toys in various manners. Because of their large number and small size, these types of toys tend to clutter the floor of the room as well as get misplaced. Accordingly, it would prove beneficial if toys of this sort were permanently mounted in such a way as to allow the child to move and arrange the toys in the manner in which he or she is accustomed, but which prevents the toys from being strewn about the room.

In addition to the foregoing, parents often experience difficulty in getting a child to remain in bed long enough for the child to go to sleep. Typically, the child simply gets out of bed and plays with the toys in his or her room. As such, a need exists for a mechanism whereby the child's attention is held, while the child is in bed, until such time as the child falls asleep.

Accordingly, it is the general object of the present invention to provide an end board for supporting a child's bed which will both hold a child's interest while the child is in bed as well as provide a source of entertainment for the child in general.

A more specific object of the present invention is to provide an end board for supporting a child's bed which has movable articles mounted in slots such that a child can move the articles along the slots in the end board.

SUMMARY OF THE INVENTION

The present invention meets these and other objects by providing, in one aspect, an end board for supporting a child's bed having a base section and an upper surface defining a thickness and a peripheral edge and extending from and spanning the width of the base section. The surface of board defines at least one slot extending at least part way through the thickness of the upper surface. At least one slidable child's toy is slidably positioned in and can be selectively located at any point along the slot. At least one of the slots extends to the peripheral edge of the upper surface and is adapted to allow one or more child's toys to be loaded into the slots.

In a preferred embodiment, the upper surface defines a plurality of spaced arcuate and rectilinear slots extending at least part way into the upper surface of the end board. The rectilinear slots can intersect and communicate with the arcuate slots allowing the child's toy to be selectively positioned at any point along the slots.

In still another embodiment, the slots extend through the thickness of the bed's end board, and the child's toys includes two opposing toy portions between which an elongated portion is interposed and positioned in the slots, such that the child can access a toy portion of the slidable child's toy from either side of the end board.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE PREFERRED EMBODIMENT

Figure 1:
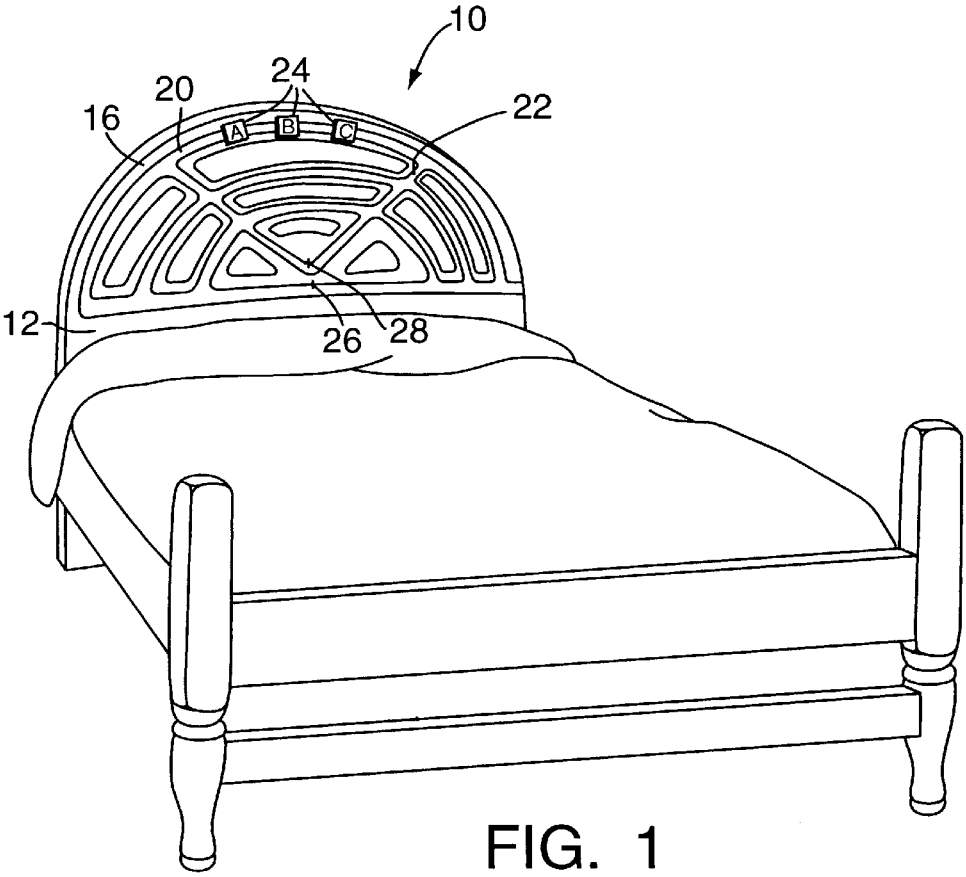
FIG. 1 is a perspective view of a bed supported by the end board of the present invention.
Figure 3:
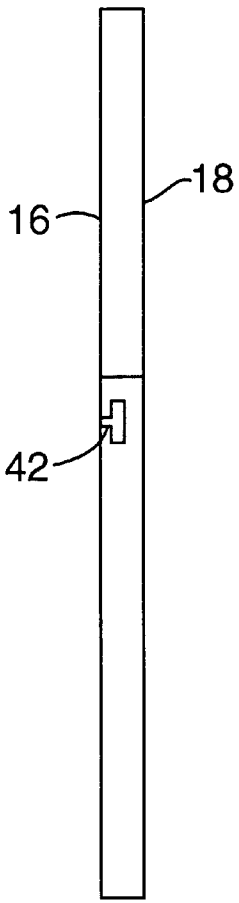
FIG. 3 is a side view of the end board of the present invention.
Figure 2:
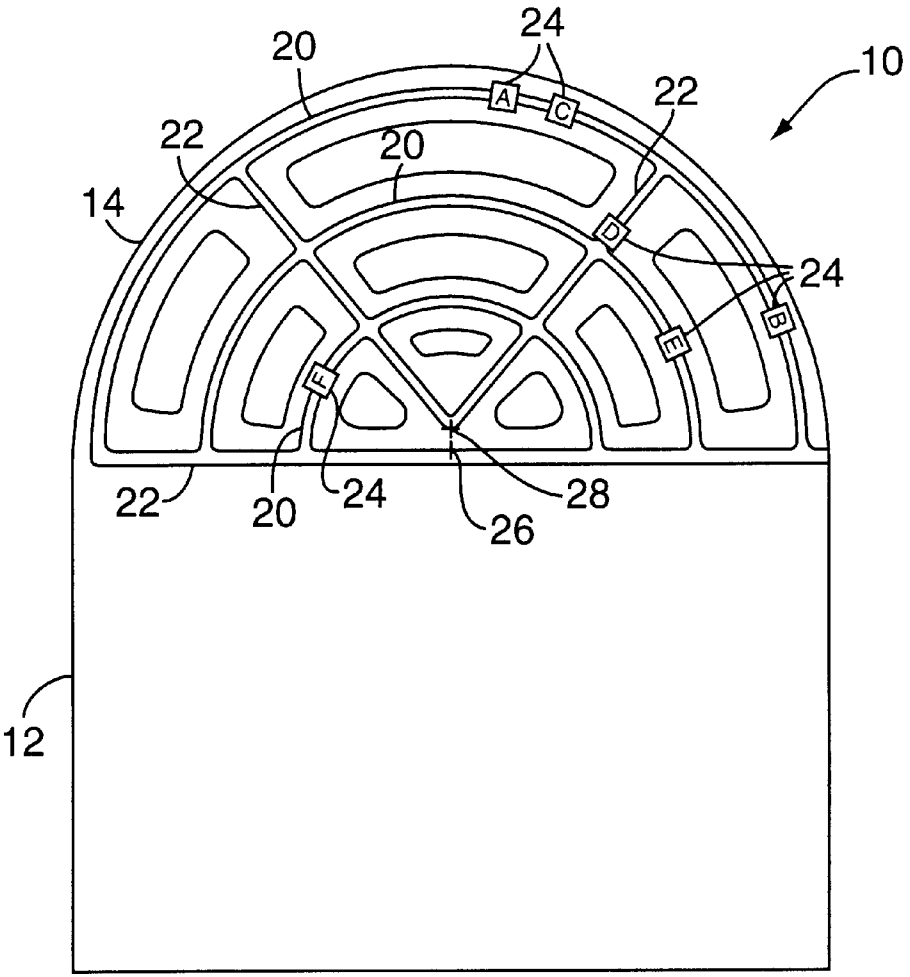
FIG. 2 is a front view of the end board of the present invention.

Turning to the drawings and first referring to FIGS. 1–3, a preferred embodiment of an end board for supporting a child's bed is there shown and generally designated as 10. The end board 10 has a base section 12, and an upper surface 14 extending from and approximately spanning the width of the base section 12. Additionally, the upper surface 14 has a front surface 16 and an opposite surface 18.

Still referring to FIG. 1, a plurality of arcuate slots 20 some of which share a common center point 26, and a plurality of rectilinear slots 22 some of which emanate and radially diverge away from common point 28 are defined by the end board. The slots 20 and 22 extend part way into the end board with some of the arcuate and rectilinear slots intersecting and communicating with one another such that an unbroken path can be traced between these slots across the front surface 16 of the end board 10. While a particular slot pattern has been shown and described, it should be understood that in its broader aspects the present invention is not limited in this regard as many other patterns, such as a serpentine, circular, or spiral pattern may be substituted without departing from the broader aspects of the present invention. A plurality of child's toys 24 are slidably received by and retained in the slots 20 and 22, by means hereinafter described, such that the child's toys 24 may be selectively positioned along the slots, 20 and 22 respectively.

Figure 4:
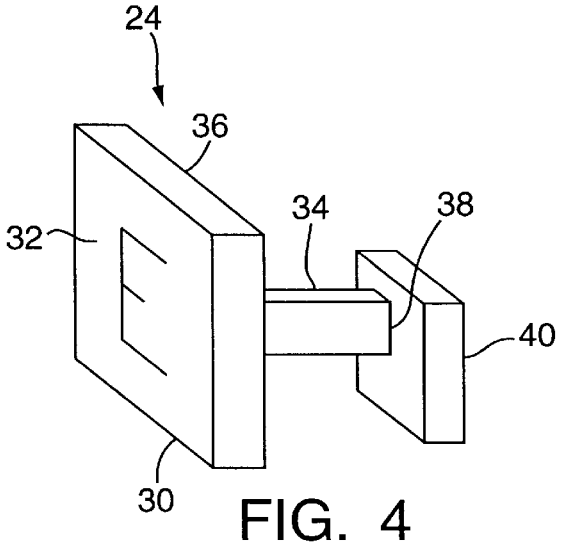
FIG. 4 is a perspective view of the child's toy of the present invention.

FIG. 4 illustrates a preferred embodiment of the child's toy 24 of the present invention. The child's toy includes a toy portion 30 which is in the form of a child's block having a front indicia carrying surface 32. An elongated section 34 of the child's toy 24 extends from the toy portion rear surface 36. The elongated section 34 has end 38 to which is attached to end section 40. While the end section 40 is shown in FIG. 3 as being square in shape, the invention is no way limited in this regard, and any shape capable of fitting into the aforementioned slots may be substituted without departing from the broader aspects of the invention.

Figure 5:
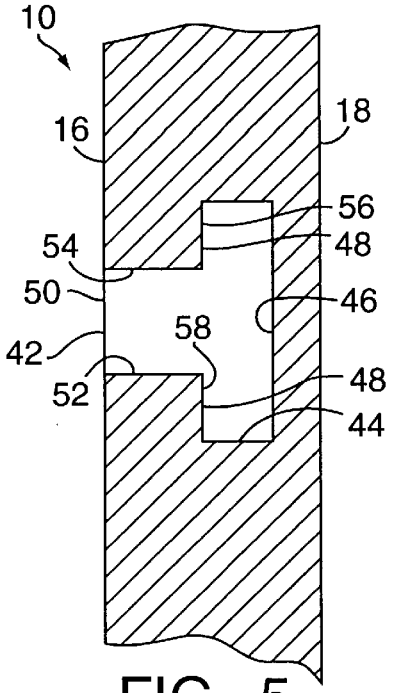
FIG. 5 is an enlarged sectional view of the "T" slot of the end board of the present invention.

Referring now to FIGS. 3 through 5, and initially to FIG. 3, there is shown a "T" shaped child's toy loading slot 42. The "T" shaped slot 42 extends into the thickness of the end board 10 from the front surface 16 and includes an inner slot section 44 defined by a rear surface 46, a front surface generally designated 48 is substantially parallel to and spaced from the rear surface, and a first pair of spaced apart opposed lateral surfaces 50 and 52 are interposed between and in communication with the front and rear surfaces, 48 and 46. Additionally, the "T" shaped slot 42 has an outer slot section 50 extending from the front surface 16 and into the inner slot section 44. The outer slot section 50 is defined by a second pair of opposed substantially parallel lateral surfaces 52 and 54 positioned such that the front surface 48 is divided by the outer slot section into two substantially equally sized portions 56 and 58.

The elongated section 34 of the child's toy 24 is adapted to be slidably received in the upper section 50 of the "T" shaped slot 42, and the end section 40 of the child's toy 24 is adapted to be slidingly received in the lower slot section 44 of the "T" shaped slot 42 thereby preventing the child's toy 24 from being removed from the slots 20 and 22. In operation, once the child's toy 24 is loaded into the "T" slot 42, the toy member 24 may be selectively slidingly moved along any of the plurality of communicating slots 20, 22. Although a "T" shaped slot has been shown and described, the present invention is not limited in this regard and any type of retention slot, such as a dovetail groove may be substituted without departing from the broader aspects of the present invention.

Figure 6:
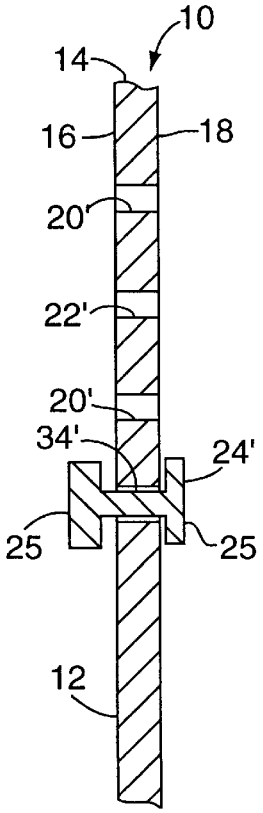
FIG. 6 is a partially in section side view of an alternate embodiment of the end board of the present invention.

Various different versions of the end board of the present invention are possible, one such other version is shown in FIG. 6 and is designated by the reference numeral 10'. Referring to this figure, the slots 20' and 22' in the end board 10' extend through the thickness of the end board from the front surface 16 to the opposite surface 18. A child's toy 24' is shown in FIG. 6 positioned in one of the slots. The toy member 24' has toy surface 25, 25 directly opposed to one another and connected by elongated section 34'. Elongated section 34' is adapted to be received in the through slots 20' and 22' such that the toy member 24' can be slidably selectively positioned at any point along the slots 20' and 22' respectively. In this embodiment, an appropriate slot pattern must be chosen, such as a serpentine pattern to avoid any unsupported sections in the endboard.

Figure 8:
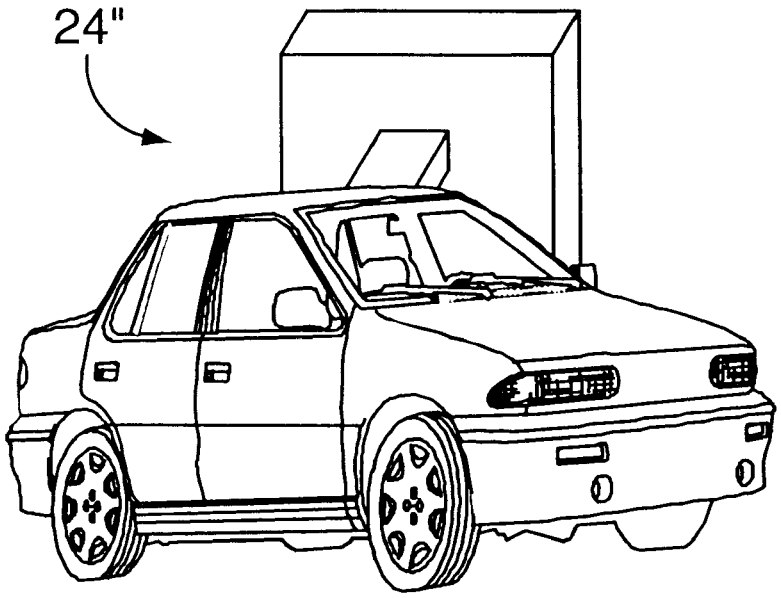
FIG. 8 is a perspective view of the child's toy of the present invention.

While child's toys 24 and 24' shown in FIGS. 4 and 6 respectively depict the toy portion as being in the form of a child's block, the invention is in no way limited in this regard, several other children's toys such as a toy car 24", as shown in FIG. 8, and for example, trains, or planes can be substituted without departing from the broader aspects of the present invention.

In another embodiment of the present invention, the front surface 16 of the end board 10 defines indicia thereon. The indicia can be in the form of, but is not limited to, depictions of scenes which are desirable to a child, such as a town wherein the slots 20 and 22 represent roads or railroad tracks, and the child's toy is in the form of a car or train. The indicia may also depict a farm scene wherein the child's toys represent farm implements such as tractors.

Figure 7:
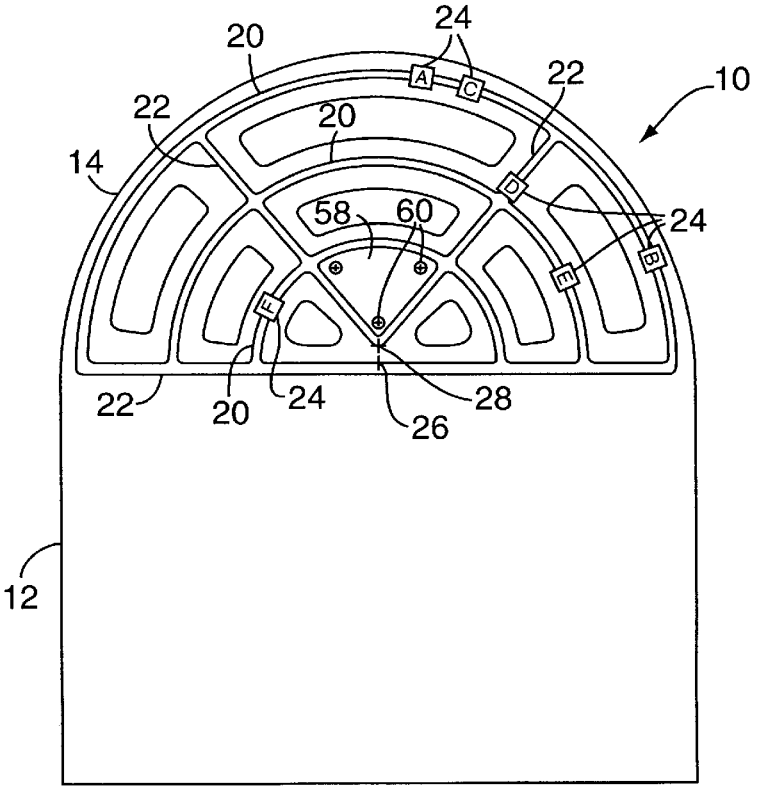
FIG. 7 is a front view of the end board of the present invention showing an alternate child's toy loading configuration.

In still another embodiment of the present invention, as shown in FIG. 7, instead of a loading slot to get the child's toys into the slots 20 and 22, a cover plate 58 is removably mounted to the end board upper section 14 by fasteners 60. While fasteners have been shown and described, the present invention is not limited in this regard and other methods of attaching the cover plate, for instance providing a snap fit mechanism, known to those skilled in the art can be employed without departing from the broader aspects of the present invention. To load the child's toys 24 into the slots, 20 and 22, the cover plate 58 is removed thereby exposing an area for receiving the child's toys such that they may be slid into one of the slots 20, 22. Once the desired number of child's toys are loaded into the slots, the cover plate 58 is replaced, thereby preventing removal of the child's toys 24 from the end board. Instead of a cover plate, a plug 59 (shown in FIG. 3) could be used to block the loading slot 42 thereby preventing removal of the child's toys 24 from the end board. The plug could be secured to the end board by a fastener, or by other means, such as press fitting the plug into the endboard.

Figure 9:
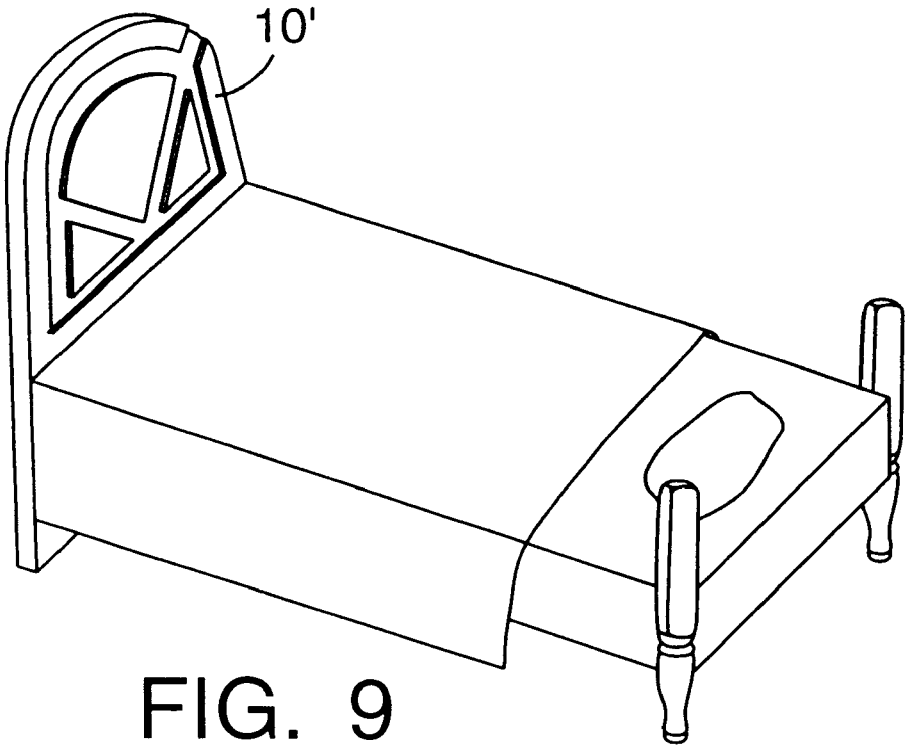
FIG. 9 is a perspective view of a bed with the end board attached as a foot board.

Referring to FIG. 1 the end board 10 for supporting a child's bed is shown coupled to and supporting a frame 60 of a bed. In the illustrated embodiment, the end board 10 is used as the headboard of the bed, thereby allowing a child to selectively position the child's toys 24 along the slots, 20 and 22 respectively, while the child is on the bed. However, the present invention is not limited in this regard as the end board 10 can be used as either the headboard, footboard, 10', as shown in FIG. 9 or both for supporting the child's bed.

While preferred embodiments have been shown and described, various modifications and substitutions may be made without departing from the spirit and scope of the present invention. Accordingly, it is to be understood that the present invention has been described by way of example, and not by limitation.

What is claimed is:

1. An end board for supporting a child's bed comprising:

a base section having a width;

an upper surface defining a thickness and a peripheral edge, and extending from and approximately spanning the width of the base section;

the upper surface of the endboard defining at least one slot extending at least part way through the thickness of the upper surface;

at least one child's toy slidably received by and selectively positionable along the slot; and wherein at least one end of the slot extends to the peripheral edge of the upper surface to allow the child's toy to be slidably positioned into the slots.

2. An endboard for supporting a child's bed as defined by claim 1, wherein the end board is a headboard.

3. An endboard for supporting a child's bed as defined by claim 1, wherein the end board is a footboard.

4. An endboard for supporting a child's bed as defined by claim 1, wherein the at least one slot includes;

a first slot extending at least part way through the thickness of the upper surface, and at least a second slot extending at least part way through the thickness of the upper surface and intersecting the first slot thereby allowing the child's toy to be slidably positioned according to an unbroken path at any point along the first and second slots.

5. An endboard for supporting a child's bed as defined by claim 1, wherein:

the at least one first slot comprises a plurality of spaced arcuate slots extending at least part way through the thickness of the upper surface; and the at least one second slot comprises a plurality of rectilinear slots extending at least part way through the thickness of the upper surface, some of which intersect and communicate with the plurality of arcuate slots.

6. An endboard for supporting a child's bed as defined by claim 1, wherein the at least one first slot comprises a plurality of rectilinear slots extending at least part way through the thickness of the upper surface.

7. An endboard for supporting a child's bed as defined by claim 1, wherein the at least one slot is a "T" shaped slot.

8. An endboard for supporting a child's bed as defined by claim 7, wherein the at least one child's toy further comprises a toy portion having a front and rear surface, an elongated section depending from the toy portion rear surface, and an end section attached to the elongated section, the elongated section being adapted to be slidably received and selectively positioned in the outer slot section of the at least one "T" shaped slot, and the end section being adapted to be slidably received and selectively positioned in the inner slot section of the at least one "T" shaped slot.

9. An endboard for supporting a child's bed as defined by claim 8 wherein the toy portion is in the form of a child's block.

10. An endboard for supporting a child's bed as defined by claim 1 wherein the at least one slot extends through the upper surface of the end board and the at least one child's toy is selectively positionable in the at least one slot.

11. An endboard for supporting a child's bed as defined by claim 10 wherein the at least one child's toy comprises first and second toy portions and an elongated section interposed therebetween and slidably positioned in the at least one slot.

12. An endboard for supporting a child's bed as defined by claim 11 wherein the first and second toy sections are in the form of a child's block.

13. An endboard for supporting a child's bed as defined by claim 1 wherein:

the upper surface includes a loading portion defined by the front surface for providing entry of the slidable member into the at least one slot; and a cover plate releasably coupled to the upper surface of the end board for covering the loading portion, thereby preventing the at least one slidable member from being removed.

14. An endboard for supporting a child's bed as defined by claim 1 wherein the at least one child's toy comprises a combination of a plurality of children's toys and a plurality of children's blocks adapted to be slidably received and selectively positioned in the at least one slot.

15. An endboard for supporting a child's bed comprising:

a base section having a width;

an upper surface extending from and spanning the width of base section, the upper surface defining a thickness and a peripheral edge;

a plurality of spaced arcuate slots defined by and extending part way through the thickness of the upper surface;

a plurality of rectilinear slots defined by and extending part way through the thickness of upper surface and being positioned in a radially divergent pattern with a portion of said rectilinear slots intersecting the plurality of arcuate slots;

the plurality of arcuate and rectilinear slots being "T" shaped;

a plurality of child's toys adapted to be slidably received in the "T" shaped slots; and at least one of the slots extending to the peripheral edge of the upper surface for loading the plurality of child's toys into the slots so that the plurality of child's toys can be slidably positioned at any point along the slots.

16. An endboard for supporting a child's bed as defined by claim 15 wherein the plurality of child's toys are in the form of a child's block.

17. An endboard for supporting a child's bed as defined by claim 15 wherein the plurality of child's toys are in the form of a child's toy.

18. An endboard for supporting a child's bed as defined by claim 15 wherein the plurality of child's toys are in the form of a combination of children's toys and blocks.

* * * * *

UNITED STATES PATENT AND TRADEMARK OFFICE

CERTIFICATE OF CORRECTION

PATENT NO. : 5,913,771

DATED : June 22, 1999

INVENTOR(S) : David Nail

It is certified that error appears in the above-identified patent and that said Letters Patent is hereby corrected as shown below:

Column 2, Lines 3-4: Delete "The surface of board" and substitute --The upper surface of the end board--.

Column 5, Line 4: After "includes", delete ";" and substitute --:--.

Signed and Sealed this

Thirtieth Day of November, 1999

*Attest:*

*Attesting Officer*

Q. TODD DICKINSON

*Acting Commissioner of Patents and Trademarks*